United States Patent [19]

Solomon et al.

[11] 4,434,722

[45] Mar. 6, 1984

[54] TILT SUPPORT FOR OVERBED TABLE TOP AND VERTICAL LOCK ASSEMBLY THEREFOR

[75] Inventors: Robert A. Solomon, Kalamazoo; John J. Dellinger, Portage, both of Mich.

[73] Assignee: Am Fab, Inc., Kalamazoo, Mich.

[21] Appl. No.: 267,092

[22] Filed: May 22, 1981

[51] Int. Cl.[3] ..... A47B 23/00; A47B 27/18

[52] U.S. Cl. ..... 108/8; 248/397

[58] Field of Search ..... 108/1, 5–8; 248/394, 396, 397, 456; 297/328

[56] References Cited

U.S. PATENT DOCUMENTS

| | | | |
|---|---|---|---|
| 268,616 | 12/1882 | Brown | 108/8 |
| 1,867,763 | 7/1932 | Rose | 108/8 |
| 2,963,170 | 12/1960 | Lori | 108/8 |
| 4,314,685 | 2/1982 | Schwan | 108/6 X |

FOREIGN PATENT DOCUMENTS

| | | | |
|---|---|---|---|
| 14036 | of 1892 | United Kingdom | 108/8 |

*Primary Examiner*—William E. Lyddane

[57] ABSTRACT

An adjustable table includes a base having an upright post with two vertical rows of openings therein. A tubular member is telescopically slidably supported on the post and has a downwardly facing bearing surface adjacent each row of openings in the post. A vertical lever is supported on the tubular member for pivotal movement about a horizontal axis, the pivotal support having a degree of vertical play, and has two locking members thereon each engageable with the openings in a respective row thereof and with a respective bearing surface on the lever. A table top is pivotally supported on the upper end of the tubular member for movement about a substantially horizontal axis and first locking means is fixably mounted on the tubular member. A leaf spring has one end fixedly secured to the undersurface of the table top and has second locking means thereon at a location spaced from the one end, the second locking means being movable between positions engaging and spaced from the first locking means by flexing the leaf spring. A selectively actuable disabling mechanism can render the leaf spring inoperative when the first and second locking means are engaged.

18 Claims, 12 Drawing Figures

TILT SUPPORT FOR OVERBED TABLE TOP AND VERTICAL LOCK ASSEMBLY THEREFOR

FIELD OF THE INVENTION

This invention relates to a table having a top, the position of which is both adjustable vertically and is adjustable pivotally about a horizontal axis and, more particularly, relates to mechanisms for releasably locking an overbed table top in selected vertical and pivotal positions.

BACKGROUND OF THE INVENTION

Tables having tops which are vertically and/or pivotally adjustable have proved useful in many applications, particularly in hospitals and similar situations in which it is desirable to have a table which may be used by a person in a bed or a chair.

One type of vertically adjustable table has a base with an upright post and a vertical row of openings in the post. A tubular member which supports the table top is telescopically slidably received over the post and has a lever supported thereon for pivotal movement about a horizontal axis, the lever having a locking pin engageable with the openings in the post. A table of this type is disclosed in U.S. Pat. No. 2,685,487. A problem with this type of arrangement is that the weight of the table top and items thereon is transferred to the lever through the pivotal support and is then transferred through the pin on the lever to the post. This necessitates a pivotal support capable of carrying a significant amount of weight, which support is expensive to manufacture and therefore increases the total cost of the table.

A problem frequently encountered with tables having pivotally adjustable tops is that the mechanism releasably securing the table in a selected pivotal position permits a certain degree of rotational play between the table top and the base structure. Mechanisms capable of significantly reducing this rotational play are known, but typically are expensive to manufacture and thus increase the cost of the table.

It is therefore an object of the present invention to provide an adjustable table having a mechanism of the type described above for releasably locking the table top in a selected vertical position, in which mechanism the pivotal support for the lever does not carry any part of the forces generated by the weight of the table and items placed thereon.

It is a further object of the present invention to provide an adjustable table having a mechanism capable of securely locking the table top in a selected pivotal position with little or no rotational play, which mechanism is relatively inexpensive to manufacture and is easy to operate.

It is a further object of the invention to provide an adjustable table, as aforesaid, which is durable and requires little or no maintenance.

SUMMARY OF THE INVENTION

The objects and purposes of the invention, including those set forth above, are met by providing a table which includes a base having an upright post with a row of vertically spaced openings therein. A tubular member slidably telescopes over the post and has a downwardly facing bearing surface at a location adjacent the row of openings in the post. A lever extends along the tubular member and is supported thereon at a second location spaced from the first location for pivotal movement about a substantially horizontal axis and for a small amount of vertical movement relative to the tubular member. A locking member is provided on the lever at a location remote from the pivot axis and adjacent the bearing surface on the tubular member. The locking member projects toward the post and is movable between positions engaging and spaced from the openings in the post through pivotal movement of the lever. The locking member is movable into and out of engagement with the bearing surface by virtue of the vertical play in the pivotal support of the lever. When the locking member is disposed in an opening in the post, the weight of the table top urges the bearing surface into engagement with the locking member and such weight is thus transferred from the tubular member directly to the locking member by the bearing surface and is then transferred from the locking member to the post. Due to the vertical play in the pivotal support of the lever, the pivotal support carries no part of the weight of the table top.

The objects and purposes of the invention are also met by providing a table top which is pivotally supported on the upper end of the tubular member for movement about a substantially horizontal pivotal axis. A first locking structure is provided on the tubular member and is fixed against movement relative thereto about the pivot axis. An elongate resiliently flexible member has one end fixedly secured to the undersurface of the table top and has a second locking structure thereon at a location spaced from such end and movable in a direction substantially radially of the pivot axis between positions spaced from and operatively engaged with the first locking structure by flexing the elongate member. The elongate member is preferably arranged to resiliently urge the second locking structure toward the engaged position. A selectively actuatable disabling mechanism is provided for rendering the elongate member inoperative when the second locking structure is engaged with the first locking structure.

BRIEF DESCRIPTION OF THE DRAWINGS

Other objects, purposes and advantages of this invention will be apparent to persons acquainted with apparatus of this general type upon reading the following specification and inspecting the accompanying drawings, in which.

Figure 1:
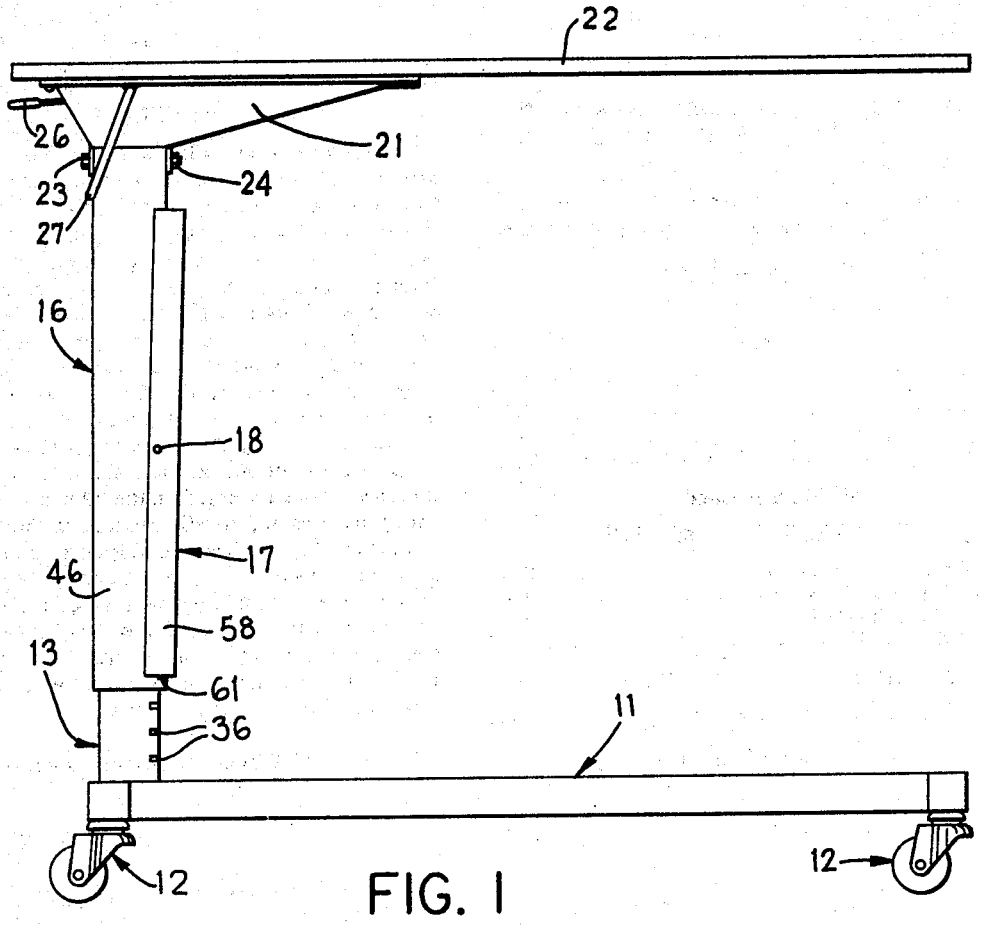
FIG. 1 is a side elevational view of an adjustable table embodying the present invention.

Certain terminology will be used in the following description for convenience in reference only and will not be limiting. The words "up" and "down" will designate directions in the drawings to which reference is made. The words "in" and "out" will respectively refer to directions toward and away from the geometric center of the device and designated parts thereof. Such terminology will include the words specifically mentioned above, derivatives thereof and words of similar import.

DETAILED DESCRIPTION

Referring to FIG. 1, a table 10 designed for bedside use includes a base 11 which is supported on a plurality of casters 12 and has an upright, rectangular post 13. In the illustrated embodiment, the post 13 is hollow.

Figure 11:
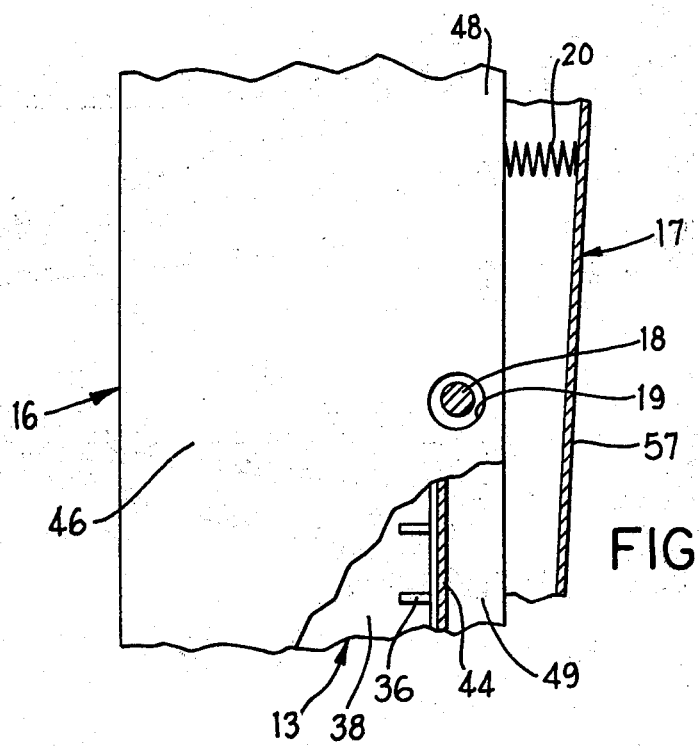
FIG. 11 is a fragmentary view of a portion of the table of FIG. 1; illustrating the pivotal support of a lever controlling the vertical adjustment mechanism.

A rectangular tubular member 16 having inside dimensions slightly greater than the outside dimensions of the rectangular post 13 is telescopically slidably received on the post 13 for vertical movement thereon. A substantially vertical lever 17 extends along and is pivotally supported intermediate its ends on the tubular member 16 by a pivot pin 18. The pivotal support for the lever 17 is designed to allow a small amount of vertical movement or play of the lever 17 relative to the tubular member 16. In the preferred embodiment, the pivotal support for the lever 17 includes a horizontal opening 19 (FIG. 11) for the pivot pin 18 provided through part of the tubular member 16 and of somewhat greater diameter than the pivot pin 18. The lever 17 is used to releasably lock the tubular member 16 in a selected vertical position with respect to the rectangular post 13 in a manner described in detail hereinafter.

A housing 21 is pivotally supported on the upper end of the tubular member 16 by a pivot bolt 23 and a nut 24. A table top 22 is mounted to the top of the housing 21. A manually operable release handle 26 extends outwardly from the housing 21 and controls a mechanism described in greater detail hereinafter which releasably locks the table top 22 in a selected pivotal position with respect to the tubular member 16. A disable handle 27 is provided for disabling the handle 26 and the mechanism controlled thereby in a manner described in detail hereinafter.

A not-illustrated counterbalance spring is provided within the tubular member 16 and urges the tubular member 16 upwardly with respect to the post 13 with a force approximately equal to the combined weight of the tubular member 16 and the parts of the table supported by the tubular member 16, thereby facilitating vertical adjustment of the tubular member 16 with respect to the post 13. The counterbalance spring is conventional (see U.S. Pat. No. 3,999,492) and is therefore not illustrated or described in detail.

Figure 6A:
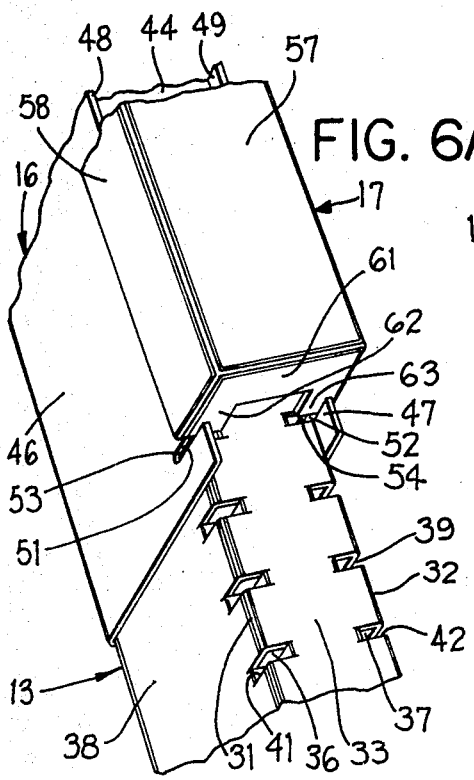
FIG. 6A is a perspective view of a portion of the vertically adjustable support of the table of FIG. 1 and illustrates details of the associated locking mechanism.

Referring to FIG. 6A, a narrow wall 33 of the rectangular post 13 is bounded by two vertically extending corners 31 and 32. A vertical row of openings 36 is provided in the post 13 along the corner 31, and a vertical row of openings 37 is provided along the corner 32. Each of the openings 36 is a horizontal slot which is provided in the wall 33 and extends around the corner 31 into the wall 38. Similarly, each of the openings 37 is a horizontal slot which is provided in the wall 33 and extends around the corner 32 into the wall 39. The bottom of each of the openings 36 has a horizontal upwardly facing bearing surface 41, and the bottom of each of the openings 37 has a horizontal upwardly facing bearing surface 42.

The rectangular tubular member 16 has a narrow wall 44 adjacent and parallel to the wall 33 of the post 13, and has two wide walls 46 and 47 adjacent and parallel to the walls 38 and 39, respectively, of the post 13. Each of the wide walls 46 and 47 extends outwardly toward the lever 17 past the narrow wall 44, thereby defining spaced, vertical flanges 48 and 49. Horizontal slots 51 and 52 are provided in the walls 46 and 47, respectively, adjacent the lower ends thereof, and extend inwardly from the outer edges of the associated flanges 48 and 49. The tops of the slots 51 and 52 define horizontal, downwardly facing bearing surfaces 53 and 54, respectively.

The lever 17 is a U-shaped channel having a web 57 and a pair of spaced parallel legs, only the leg 58 being visible in FIG. 6A. The distance between the legs of the lever 17 is slightly greater than the distance between the flanges 48 and 49, and the portions of the walls 46 and 47 adjacent and including the flanges 48 and 49 are disposed between the legs of the lever 17.

A U-shaped end wall 61 is provided at the lower end of the lever 17, and the legs 62 and 63 of the end wall 61 define spaced, substantially horizontal locking flanges which project toward the post 13 and are each slidably received within a respective one of the slots 51 and 52 in the walls 46 and 47 of the tubular member 16. The thickness of the end wall 61 is less than the vertical height of the openings 36 and 37 in the post 13, whereby the legs 62 and 63 can be received in a pair of horizontally aligned openings 36 and 37 when the lever 17 is pivoted about the pin 18 to the position illustrated in FIG. 6B.

Figure 6B:
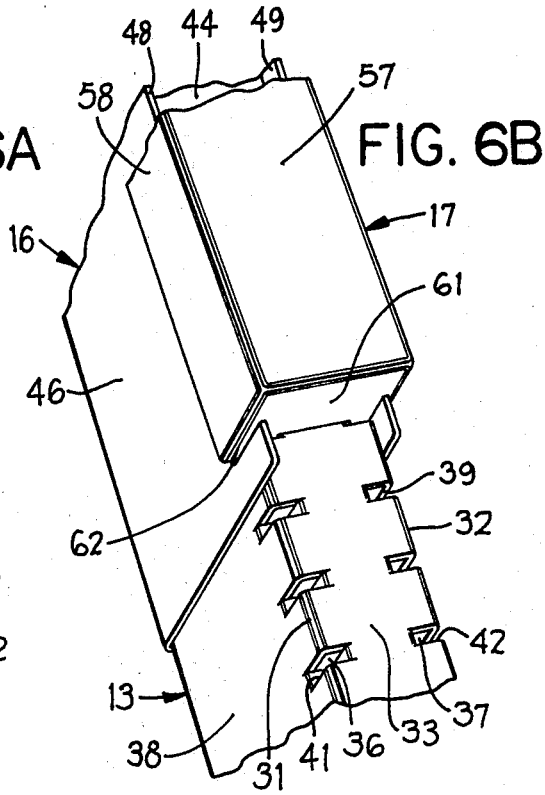
FIG. 6B illustrates the structure of FIG. 6A in a different position of operation.

A return spring 20 (FIG. 11) is provided between the tubular member 16 and the lever 17 above the pivot pin 18 and urges the lever 17 pivotally about the pivot pin 18 toward the position illustrated in FIG. 6B.

The housing 21 is generally wedge-shaped and is secured to the undersurface of the table top 22 by a screw 71 (FIGS. 2 and 4) adjacent the point of the wedge and two screws 72 at the opposite end. A generally rectangular recess 73 is provided near the top of the housing at the end adjacent the screws 72, and a rectangular opening 74 is provided in the bottom of the housing 21 near the same end. A pair of flanges 76 and 77 extends downwardly from opposite ends of the rectangular opening 74. The dimensions of the rectangular opening 74 are somewhat greater than the dimensions of the tubular member 16, and the tubular member 16 extends upwardly through the rectangular opening 74. A vertical plate 78 is fixedly secured to the narrow wall 44 of the tubular member 16 in a conventional manner, and the pivot bolt 23 extends through aligned openings provided in the flanges 76 and 77, the narrow walls of the tubular member 16, and the plate 78. An annular spacer 79 is provided on the bolt 23 between the plate 78 and the flange 77 so that tightening the nut 24 does not cause the flange 77 to bend inwardly and bind against the vertical flanges 48 and 49 on the tubular member 16. A washer 81 is preferably provided between the nut 24 and the flange 77.

Figure 5:
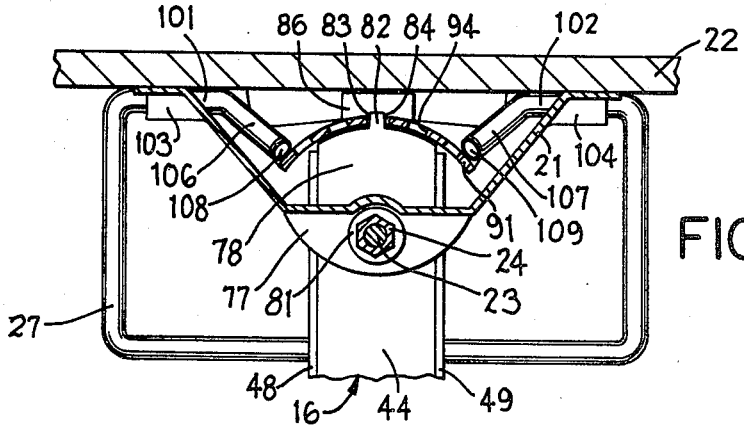
FIG. 5 is a sectional view taken along the line V—V of FIG. 4.

The top of the plate 78 is preferably arcuate, as best illustrated in FIG. 5, and has an upright, wedge-shaped locking pin 82 with upwardly converging lateral side surfaces 83 and 84.

The housing 21 has an upright guide plate 86 (FIG. 2) which is coplanar with the flange 76, preferably an extension of the flange 76, extends upwardly to the undersurface of the table top 22, and has a substantially uniform lateral width.

An elongate, resiliently flexible leaf spring 91 (FIG. 2) has one end securely fixed to the undersurface of the table top 22 by the screw 71 and is bent to extend through the housing 21 and out the recess 73 thereof at a small acute angle with respect to the undersurface of the table top 22. A rectangular guide opening 92 is provided in the leaf spring 91 and has a lateral width substantially equal to that of the guide member 86, the guide member 86 extending through the opening 92 and having its lateral side surfaces slidably engaging the lateral edges of the rectangular opening 92. The cooperation between the guide member 86 and the guide opening 92 prevents rotational movement of the leaf spring 91 about the axis of the pivot bolt 23 relative to the housing 21 and table top 22.

A central portion 93 of the leaf spring 91 is bent to an arcuate shape, the axis of the arcuate portion 93 being substantially coaxial with the pivot pin 23. A plurality of arcuately spaced rectangular lock openings 94 are provided in the arcuate portion 93. The openings 94 are successively alignable with the wedge-shaped pin 82 as the table top 22 is pivoted relative to the tubular member 16, and each opening 94 has a lateral width which is greater than the smallest distance between the side surfaces 83 and 84 of the pin 82 and less than the greatest distance between the side surfaces 83 and 84. The arcuate portion 93 of the leaf spring 91 is urged downwardly by the resiliency of the leaf spring 91 until the lateral edges of an opening 94 aligned with the pin 83 engage the lateral side surfaces 83 and 84 of the pin 82.

Figure 3:
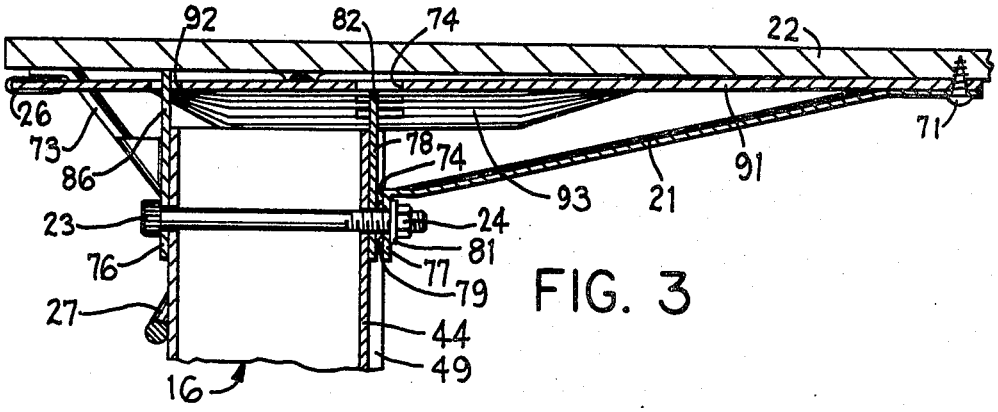
FIG. 3 is a view of the structure of FIG. 2 in a different position of operation.

The free end 26 of the leaf spring 91 serves as a release lever and has a manually engageable plastic grip 96 (FIG. 4) thereon. By manually lifting the free end of the leaf spring 91, the leaf spring 91 can be flexed upwardly until the arcuate portion 93 is spaced from the pin 82, as illustrated in FIG. 3.

The disable handle 27 (FIG. 4) is a C-shaped rod, the coaxial shorter legs 101 and 102 of which are disposed in semicircular depressions 103 and 104 in the top of the housing 21 and serve as pivot axles for the handle 27. The handle 27 thus pivots about an axis positioned above and perpendicular to the axis of the pivot bolt 23.

Respective cam members 106 and 107 are provided on the ends of the legs 101 and 102 and have respective ends 108 and 109 which are preferably rounded. When the handle 27 is in the release position, shown in solid lines in FIGS. 2 and 4, the cam members 106 and 107 are spaced from the upper side of the leaf spring 91, so that the leaf spring 91 can be freely moved manually between the positions illustrated in FIGS. 2 and 3. As the handle 27 is rotated to the disable position, shown in broken lines in FIGS. 2 and 4, the ends 108 and 109 of the cam members 106 and 107 engage the top of the arcuate portion 93 of the leaf spring 91 adjacent opposite lateral edges thereof and urge the arcuate portion 93 downwardly so that the edges of the opening 94 aligned with the pin 82 are firmly urged into engagement with the lateral side surfaces 83 and 84 of the wedge-shaped pin 82. The cam members 106 and 107 are preferably arranged so that they will pass deadcenter positions in which they are substantially perpendicular to the arcuate surface 93 of the spring 91 just before the handle 27 reaches the position shown in broken lines in FIGS. 2 and 4, thereby creating a toggle effect which tends to yieldably resist movement of the handle 27 away from such position.

Figure 7:
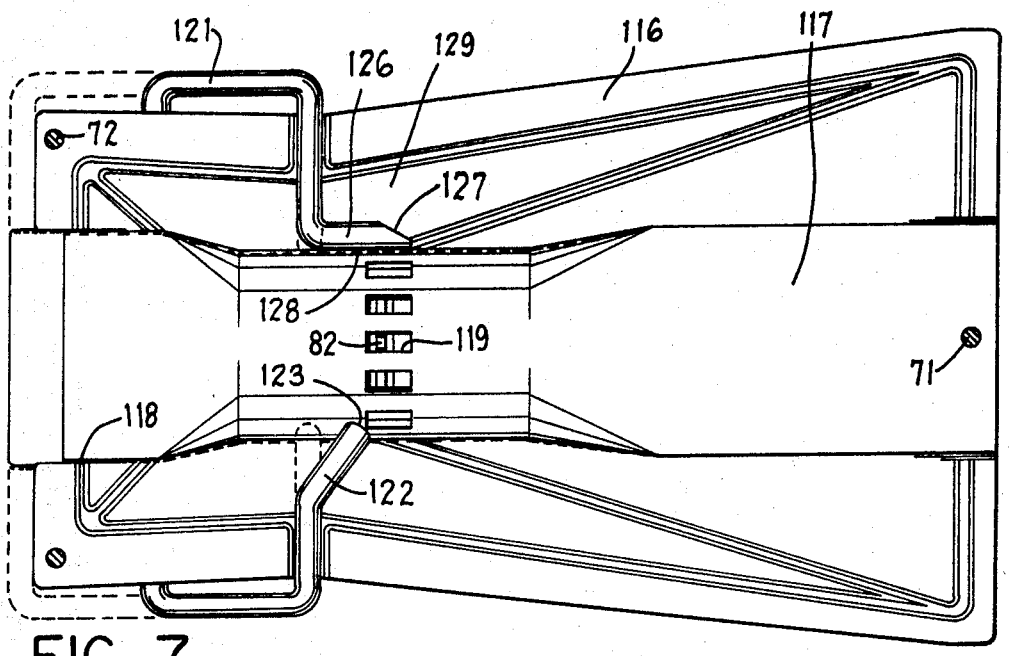
FIG. 7 is a view similar to FIG. 4 of a second exemplary embodiment of a locking mechanism for the pivotal top of the table of FIG. 1.

The embodiment of FIG. 7 is substantially identical to that of FIGS. 1–6 except as discussed below. The leaf spring 117 is generally similar to the leaf spring 91 of FIG. 4, except that it has no guide opening comparable to the guide opening 92 of leaf spring 91. The housing 116 of FIG. 7 is similar to the housing 21 of FIG. 4, except that it has no vertical guide plate comparable to the guide plate 86 of the housing 21 and the recess 118 at the left end thereof is of lesser lateral width than the corresponding recess 73 of the housing 21 of FIG. 4. The lateral width of the recess 118 is slightly greater than the lateral width of the leaf spring 117, so that the vertical walls of the recess 118 are adjacent the edges of the leaf spring 117 and prevent movement of the leaf spring 117 about the axis of the bolt 23 with respect to the housing 116.

A C-shaped release handle 121 is pivotally supported on the housing 116, and has on one of its shorter legs a cam member 122 with a rounded end 123 which moves into engagement with the top of the arcuate portion of the leaf spring 117 adjacent a lateral edge thereof as the handle 121 is rotated to the position shown in broken lines. The other short leg of the handle 121 has a cam member 126 which is arranged at substantially a right angle thereto and has an inclined end 127 which faces away from the leaf spring 117 and toward the adjacent wall 129 of the housing 116. When the handle 121 is rotated to the disable position which is shown in broken lines, the side 128 of the cam member 126 engages the adjacent lateral edge of the leaf spring 117 and the inclined end surface 127 engages an inclined wall 129 of the housing 116.

Figure 8:
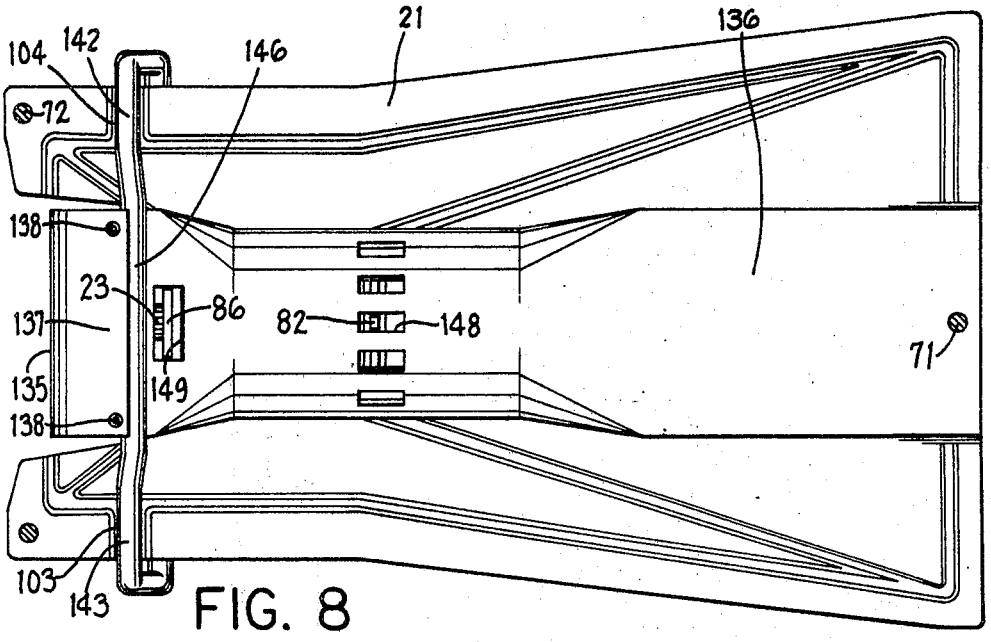
FIG. 8 is a view similar to FIG. 4 illustrating a third embodiment of a locking mechanism for the pivotal top of the table of FIG. 1.
Figure 9:
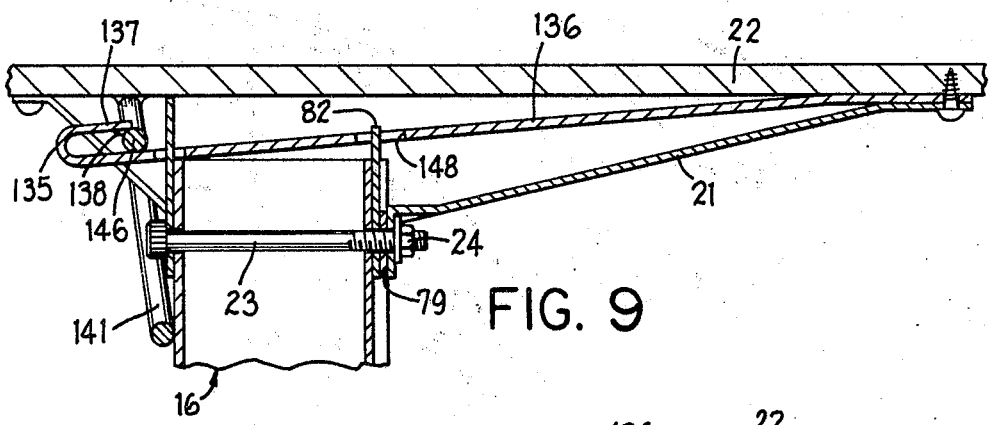
FIG. 9 is a sectional side view of the structure illustrated in FIG. 8.
Figure 10:
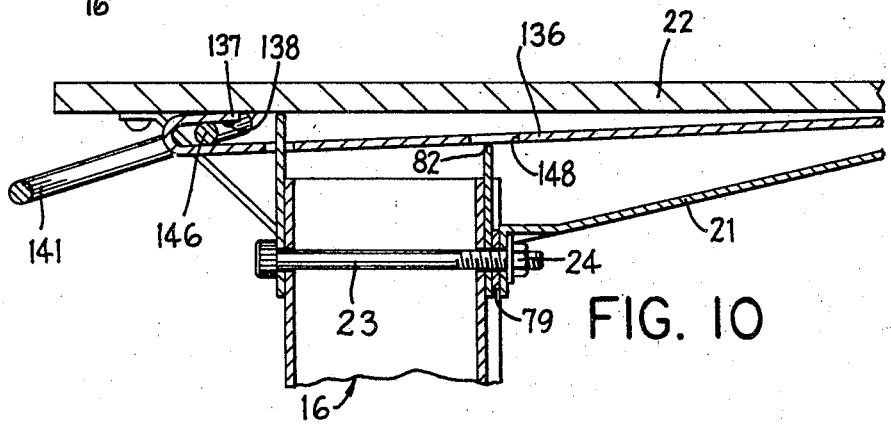
FIG. 10 is a sectional view illustrating the structure of FIG. 9 in a different position of operation.

A third embodiment is illustrated in FIGS. 8–10 and, except as discussed hereinafter, is similar to the embodiment of FIGS. 1–6. Referring to FIGS. 8 and 9, the leaf spring 136 has a U-shaped bend 135 near its free end 137 so that the free end 137 is disposed above and is substantially parallel to the remainder of the leaf spring 136. A pair of spaced, downwardly projecting detents 138 is provided on the free end 137 of the leaf spring 136.

A generally rectangular release handle 141 has spaced bearing portions 142 and 143 on a longer side thereof which are pivotally supported in the depressions 103 and 104 in the housing 21. The handle 141 is bent so that the shaft portion 146 between the bearing portions 142 and 143 is parallel to and radially offset from the axis defined by the bearing portions 142 and 143, and the offset portion 146 is slidably received between the legs of the U-shaped bend 135 to operatively couple the offset portion 146 to the leaf spring 136, the distance between the legs of the U-shaped bend being slightly greater than the diameter of the portion 146.

OPERATION

Although the operation of the table described above will be understood from the foregoing description by persons skilled in the art, a summary of such operation is now given for convenience.

Referring to FIG. 1, vertical adjustment of the table top 22 is effected by manually grasping the upper end of the lever 17 and moving it toward the tubular member 16, so that the lever 17 pivots around the pivot pin 18 and the lower end of the lever 17 moves to the position illustrated in FIG. 6A in which the legs or flanges 62 and 63 of the end plate 61 are spaced from the openings 36 and 37 in the post 13. The table top 22 and tubular member 16 can then be raised or lowered to a desired position in which the flanges 62 and 63 of the end plate 61 are respectively aligned with a different set of openings 36 and 37 in the post 13. The handle 17 can then be released and the not-illustrated return spring will urge the legs 62 and 63 into the openings 36 and 37 aligned therewith so that the handle 17 is in the position illustrated in FIG. 6B. The weight of the tubular member 16 and the elements supported thereby, including the table top 22, will urge the tubular member 16 downwardly relative to the post 13, so that the flanges 62 and 63 are firmly clamped between the downwardly facing bearing surfaces 53 and 54 on the tubular member 16 and the upwardly facing bearing surfaces 41 and 42 in the openings 36 and 37, respectively. The entire weight of the upper part of the table acting on the tubular member 16 is thus transferred through the bearing surfaces 53 and 54 to the flanges 62 and 63 and then to the bearing surfaces 41 and 42 on the post 13. The vertical play in the pivotal support 18 for the lever 17 ensures that the downwardly facing bearing surfaces 53 and 54 can freely move into firm engagement with flanges 62 and 63 and thus ensures that no part of the weight of the table will be carried by the pivotal support. This pivotal support is less expensive to manufacture and easier to assemble than one which must carry part of the weight of the table or is designed with precise tolerances.

Figure 2:
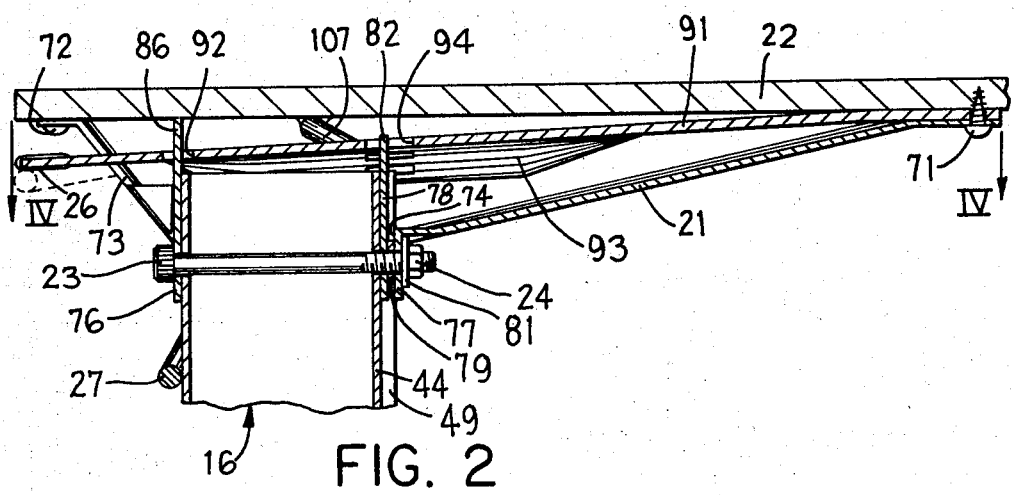
FIG. 2 is an enlarged sectional view of an upper portion of the table of FIG. 1, illustrating the pivotal support for the table top and the associated locking mechanism.
Figure 4:
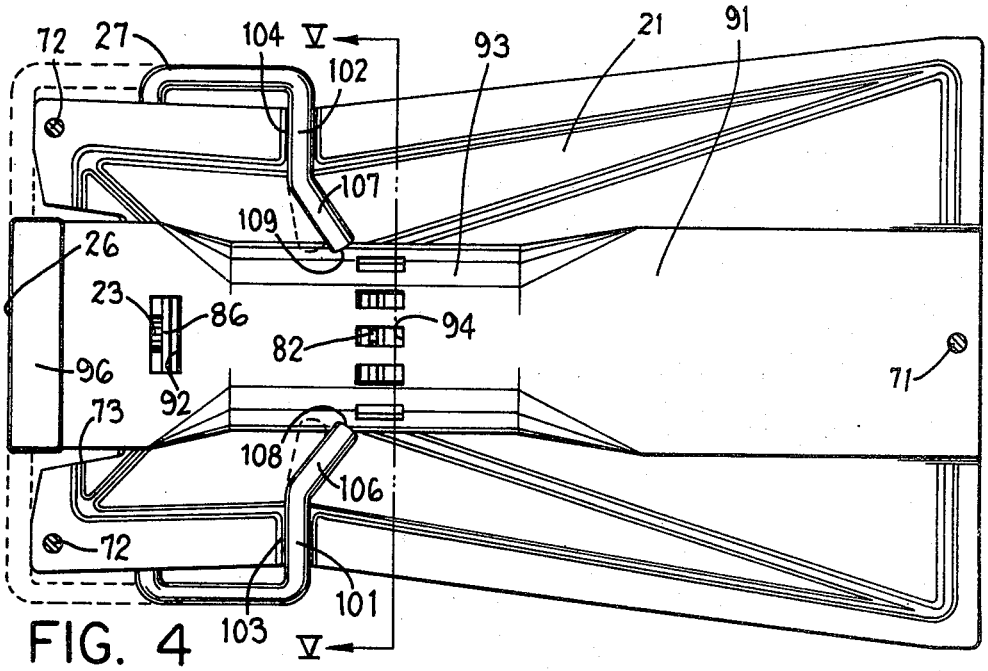
FIG. 4 is a sectional view taken along the line IV—IV of FIG. 2.

To pivotally adjust the top 22 of the table 10 relative to the tubular member 16, the disable handle 27 (FIGS. 1 to 5) is moved to the release position shown in solid lines in FIGS. 2 and 4, and the free end 26 of the leaf spring 91 is grasped manually and is raised to a position adjacent the undersurface of the table 22, as shown in FIG. 3, so that the spring 91 is flexed and moves to a position adjacent the undersurface of the table 22 throughout its length. In this position, the openings 94 in the arcuate portion 93 of the leaf spring 91 will be disengaged from the wedge-shaped pin 82, so that the table top 22 may be pivoted about the pivot bolt 23 to a position in which the wedge-shaped pin 82 is radially aligned with a different one of the openings 94 in the leaf spring 91. The free end 26 of the leaf spring 91 is then released, and the leaf spring 91 will return itself to its original position, illustrated in FIG. 2, with the wedge-shaped pin 82 engaging an opening 94 in the leaf spring 91.

The disable handle 27 is then pivoted toward the disable position shown in broken lines in FIGS. 2 and 4. As the disable handle 27 pivots, the ends 108 and 109 of the cam members 106 and 107 will engage the arcuate portion 93 of the leaf spring 91 adjacent opposite lateral edges thereof, inhibiting movement of the spring 91 away from the position shown in FIG. 2 and urging the arcuate portion 93 downwardly so that the lateral edges of the opening 94 are firmly wedged against the lateral side surfaces of the wedge-shaped pin 82, thereby minimizing relative rotational play between the table top 22 and the tubular member 16 about the axis of the pivot bolt 23. Since the cam members 106 and 107 will have just passed a dead-center position with respect to the leaf spring 91 when the handle reaches the disable position shown in broken lines in FIGS. 2 and 4, a toggle effect is produced which resists movement of the handle 27 away from such position.

Referring now to the embodiment of FIG. 7, the pivotal adjustment of the table top to a different position relative to the base is effected in a manner similar to that just described by moving handle 121 to the release position shown in solid lines, manually lifting the free end of the leaf spring 117, and pivoting the table top to the desired position. When the free end of the leaf spring 117 is released, the leaf spring 117 returns to its original position and the wedge-shaped pin 82 enters into engagement with an opening 119 now aligned therewith. The handle 121 is then rotated toward the disable position shown in broken lines in FIG. 7, and the cam member 126 thereon rotates to a position between the leaf spring 117 and the adjacent wall 129 of the housing 116, with the side surface 128 of the cam member 126 engaging the edge of the leaf spring 117 and the inclined end 127 of the cam member 126 engaging the wall 129 of the housing 116. Simultaneously, the rounded end 123 of the cam member 122 moves into engagement with the top of the arcuate portion of the leaf spring 117 adjacent the opposite lateral edge thereof, urging the leaf spring 117 downwardly so that the lateral edges of the opening 119 firmly engage the side surfaces of the wedge-shaped pin 82, preventing upward movement of the leaf spring 117, and urging the leaf spring 117 laterally against the cam member 126 which is in turn supported against the wall 129 of the housing 116.

Referring to the embodiment illustrated in FIGS. 8–10, pivotal adjustment of the table top relative to the base is effected by moving the handle 141 from the disable position illustrated in FIGS. 8 and 9 to the release position illustrated in FIG. 10. As the handle 141 is pivoted toward the release position, the offset portion 146 thereof is moved upwardly toward the undersurface of the table top 22 and thus urges the free end 137 of the spring 136 upwardly so that when the handle 141 reaches the release position the openings 148 in the arcuate portion of the spring 136 are spaced from the wedge-shaped pin 82. Thus, in this embodiment, it is unnecessary to manually raise the leaf spring 136. The table top 22 is then pivoted to a different position with respect to the tubular member 16, so that a different opening 148 is aligned with the wedge-shaped pin 82, and the handle 141 is then pivoted back toward the disable position illustrated in FIGS. 8 and 9. As the handle 141 is returned to the disable position, the offset portion 146 moves downwardly, permitting the leaf spring 136 to return to its initial position, and ultimately urging the leaf spring 136 downwardly so that the lateral side surfaces of the openings 148 therein firmly engage the lateral side surfaces of the wedge-shaped pin 82. Just before the handle 141 reaches the disable position illustrated in FIGS. 8 and 9, the offset portion 146 snaps past the detents 138 provided at the free end 137 of the leaf spring 136, and the detents 138 then serve to yieldably resist movement of the handle 141 away from the disable position.

Although three preferred embodiments of the invention have been disclosed in detail for illustrative purposes, it will be recognized that variations or modifications of the disclosed apparatus, including the rearrangement of parts, lie within the scope of the present invention. For example, it would be within the scope of the invention to replace the leaf spring 91 of FIG. 2 with a metal plate of similar shape pivotally supported at its right-hand end to the undersurface of the table top and to provide a spring to pivotally urge the metal plate away from the undersurface of the table top.

The embodiments of the invention in which an exclusive property or privilege is claimed are defined as follows:

1. A table, comprising:

a base;

a table top pivotally supported on said base for movement about a substantially horizontal first pivot axis;

means for releasably securing said table top in a selected pivotal position with respect to said base, including:

first locking means provided on one of said table top and said base and fixed against movement relative thereto about said first pivot axis;

an elongate member movably supported on the other of said table top and said base and having second locking means thereon, said second locking means being movable in a direction substantially radially of said first pivot axis between positions spaced from and operatively engaged with said first locking means by moving said elongate member;

first means for resiliently urging said second locking means toward one of said engaged and spaced positions; and second means for resisting movement of said elongate member about said first pivot axis relative to said other of said table top and said base;

wherein said elongate member is resiliently flexible and one end thereof is fixedly secured to said other of said table top and said base, said second locking means being spaced from said one end of said elongate member, said movement of said elongate member being effected by flexing said member, and said first means being said resilience of said elongate member.

2. The table of claim 1, wherein:

said first locking means is located radially inwardly of said second locking means with respect to said first pivot axis and includes a radially outwardly extending locking pin; and said second locking means includes a surface of said elongate member which faces said pin having a plurality of spaced lock openings therein, said openings being successively aligned with said locking pin as said table top is pivoted relative to said base and said locking pin being received in a said opening when said second locking means is in said engaged position.

3. The table of claim 2, wherein said surface of said elongate member is arcuate and approximately coaxial with said first pivot axis.

4. The table of claim 3, wherein:

said first locking means is provided on said base, said radially extending locking pin being substantially upright; and said elongate member is provided on said table top, said one end thereof being secured to and said elongate member forming a small acute angle with respect to the undersurface of said table top, said direction of movement of said second locking means being substantially perpendicular to the undersurface of said table top and said first means urging said second locking means toward said engaged position.

5. A table, comprising:

a base;

a table top pivotally supported on said base for movement about a substantially horizontal first pivot axis; and means for releasably securing said table top in a selected pivotal position with respect to said base, including:

first and second cooperating locking parts, each said part being provided on a respective one of said base and said table top and fixed against rotational movement with respect thereto about said first pivot axis, one said locking part being a locking pin extending in a direction substantially radially of said first pivot axis and the other said locking part having an arcuate surface substantially coaxial with said first pivot axis and having a plurality of angularly spaced openings in said arcuate surface;

means supporting at least one of said locking parts for movement toward and away from the other said part substantially in said direction between positions spaced from and engaging each other, said locking pin of said one part being received in a said opening in said other locking part when said parts are in said engaging position; and selectively actuable disabling means for preventing movement of said locking parts away from said engaging position.

6. The table of claim 5, wherein said base includes: an upright post, said upright post having a vertical row of spaced openings and each said opening having an upwardly facing first bearing surface therein; a tubular member slidably telescoping over said post for vertical movement with respect thereto, said tubular member having a downwardly facing second bearing surface at a first location thereon adjacent said row of openings in said post; a lever extending along said tubular member and means at a second location on said tubular member spaced from said first location supporting said lever for pivotal movement about a substantially horizontal second pivot axis and for a small range of vertical movement relative to said tubular member, said lever having a lock member thereon at a location remote from said second pivot axis and adjacent said second bearing surface, said lock member projecting toward said post and being movable between positions spaced from and engaging an opening of said row of openings in said post as said lever is pivoted and being movable between positions spaced from and engaging said second bearing surface as said lever is moved within said range of vertical movement relative to said tubular member; and means cooperable with said lever for urging said lock member toward said position engaged with an opening in said post; and wherein said table top is pivotally supported on said tubular member.

7. A table, comprising:

a base;

a table top pivotally supported on said base for movement about a substantially horizontal first pivot axis;

means for releasably securing said table top in a selected pivotal position with respect to said base, including:

first locking means provided on one of said table top and said base and fixed against movement relative thereto about said first pivot axis;

an elongate member movably supported on the other of said table top and said base and having second locking means thereon, said second locking means being movable in a direction substantially radially of said first pivot axis between positions spaced from and operatively engaged with said first locking means by moving said elongate member;

first means for resiliently urging said second locking means toward one of said engaged and spaced positions;

second means for resisting movement of said elongate member about said first pivot axis relative to said other of said table top and said base; and selectively actuable disabling means cooperable with said elongate member when said second locking means is in said engaged position for preventing movement of said second locking means away from said engaged position.

8. The table of claim 7, wherein said first locking means includes a locking pin which extends approximately radially with respect to said first axis, and said second locking means includes a surface of said elongate member which faces said pin having a plurality of spaced lock openings therein, said openings being successively aligned with said locking pin as said table top is pivoted relative to said base and said locking pin being received in a said opening when said second locking means is in said engaged position.

9. The table of claim 8, wherein:

said locking pin is wedge-shaped, the lateral side surfaces thereof converging toward said elongate member with respect to each other;

each said lock opening in said elongate member has a lateral width less than the greatest lateral width of said wedge-shaped pin and greater than the smallest lateral width of said wedge-shaped pin; and said disabling means effects firm urging of said second locking means against said first locking means;

whereby said wedge-shaped locking pin is firmly wedged into a said opening in said elongate member when said second locking means is in said engaged position and said disabling means is actuated, thereby minimizing rotational play between said table top and said base.

10. The table of claim 9, wherein said first locking means is provided on said base and said locking pin extends radially outwardly, wherein said elongate member is provided on said table top, one end thereof being supported on and said elongate member forming a small acute angle with respect to the undersurface of said table top, said second locking means being located radially outwardly of said first locking means with respect to said pivot axis, wherein said first means urges said second locking means toward said engaged position, and wherein said surface on said elongate member faces radially inwardly toward said locking pin, is arcuate, and is approximately coaxial with said first pivot axis.

11. The table of claim 10, wherein said disabling means includes a handle supported on said table top for pivotal movement between a disable position and a release position, said handle having cam means thereon which engages said elongate member on a side thereof opposite said arcuate surface as said handle is moved to said disable position for effecting said firm wedging of said locking pin into engagement with a said opening and for preventing movement of said second locking means away from said engaged position. opening and for preventing movement of said second locking means away from said engaged position.

12. The table of claim 11, wherein:

said elongate member is a leaf spring, a portion of said leaf spring spaced from said one end being of arcuate shape and having said arcuate surface thereon;

said handle is pivotal about a second pivot axis adjacent and substantially parallel to the undersurface of said table top and substantially perpendicular to said first pivot axis; and said cam means includes a pair of spaced cam elements engageable with said arcuate portion of said elongate member adjacent opposite lateral edges thereof.

13. The table of claim 12, wherein said cam elements pass a position of dead-center engagement with said elongate member just before said handle reaches said disable position, thereby producing a toggle effect which resists movement of said handle away from said disable position.

14. The table of claim 11, including means operatively coupling said cam means and said elongate member for effecting flexing of said elongate member in response to movement of said handle, movement of said handle between said disable position and said release position effecting flexing of said elongate member and movement of said second locking means between said engaged and spaced position, respectively.

15. The table of claim 14, wherein:

said handle is pivotally supported on said table top for movement about a second pivot axis adjacent and substantially parallel to the undersurface of said table top and perpendicular to said first pivot axis, said cam means including a shaft segment extending parallel to and radially offset from said second pivot axis; and said coupling means includes said elongate member having a U-shaped bend adjacent the end thereof opposite said one end, the distance between the legs of said U-shaped bend being slightly greater than the diameter of said offset shaft segment and said offset shaft segment being disposed between the legs of said U-shaped bend.

16. The table of claim 15, including detent means provided on said opposite end of said elongate member and cooperable with said shaft segment for resisting movement of said handle from said disable position.

17. The table of claim 10, including housing means fixed to the underside of said table top adjacent said elongate member and wherein:

said elongate member is a leaf spring, a portion thereof spaced from said one end being of arcuate shape and having said arcuate surface thereon;

said disabling means includes a handle supported on said housing means for pivotal movement between a disable position and a release position about a second pivot axis adjacent and substantially parallel to the undersurface of said table top and perpendicular to said first pivot axis, said handle having a first cam member which engages said arcuate portion of said elongate member on a side thereof opposite said arcuate surface as said handle is moved to said disable position for inhibiting movement of said second locking means away from said engaged position; and said second means includes a second cam member provided on said handle and snugly received between a lateral edge of said arcuate portion of said elongate member and an adjacent portion of said housing as said handle moves to said disable position, said first cam member engaging said arcuate portion adjacent the opposite lateral edge thereof for holding said elongate member firmly against said second cam member.

18. The table of claim 7, wherein said first locking means is provided on said base; wherein said elongate member is provided on said table top, one end thereof being supported on and said elongate member forming a small acute angle with respect to the undersurface of said table top, said direction of movement of said second locking means being approximately perpendicular to the undersurface of said table top; and wherein said second means includes a guide opening through said elongate member at a location spaced from said one end and a guide member fixedly supported on said table top substantially perpendicular to the undersurface thereof, said guide member and said guide opening having substantially equal lateral dimensions and said guide member being slidably received in said guide opening.

* * * * *

UNITED STATES PATENT AND TRADEMARK OFFICE

CERTIFICATE OF CORRECTION

PATENT NO. : 4 434 722

DATED : March 6, 1984

INVENTOR(S) : Robert A. Solomon et al

It is certified that error appears in the above-identified patent and that said Letters Patent is hereby corrected as shown below:

Column 12, line 3; delete "opening and".
line 4; delete in its entirety.
line 5; delete in its entirety.

Signed and Sealed this

*Twenty-second* Day of *May 1984*

[SEAL]

*Attest:*

GERALD J. MOSSINGHOFF

*Attesting Officer*

*Commissioner of Patents and Trademarks*